US006555949B2

(12) United States Patent
Becker

(10) Patent No.: US 6,555,949 B2
(45) Date of Patent: Apr. 29, 2003

(54) ELECTRIC LAMP WITH A BASE ON ONE SIDE

(75) Inventor: Juergen Becker, Berlin (DE)

(73) Assignee: Patent-Treuhand-Gesellschaft fur elektrische Gluhlampen mbH, Munich (DE)

( * ) Notice: Subject to any disclaimer, the term of this patent is extended or adjusted under 35 U.S.C. 154(b) by 0 days.

(21) Appl. No.: 09/963,523

(22) Filed: Sep. 27, 2001

(65) Prior Publication Data

US 2002/0038993 A1 Apr. 4, 2002

(30) Foreign Application Priority Data

Sep. 29, 2000 (DE) ..... 100 48 818

(51) Int. Cl.[7] ..... H01J 5/48; H01J 5/50
(52) U.S. Cl. ..... 313/318.01; 313/318.09
(58) Field of Search ..... 313/318.01, 318.02, 313/318.03, 318.09

(56) References Cited

U.S. PATENT DOCUMENTS 3,548,243 A * 12/1970 Magherini ..... 313/318.09

* cited by examiner

*Primary Examiner*—Sandra O'Shea
*Assistant Examiner*—Sumati Krishnan
(74) *Attorney, Agent, or Firm*—William F. Meyer

(57) ABSTRACT

The invention relates to an electric lamp with a base on one side, having a base (4) which has a holder (5) for a lamp vessel (2), the holder (5) being provided with a stop (5*a*) for one end of the lamp vessel (2), and the base (4) having spring elements (3) for fixing the lamp vessel (2) in the base (4). According to the invention, the lamp vessel (2) is equipped with an annular groove (2*a*), and the spring elements (3) are designed such that they act on the lamp vessel (2) in the area of the annular groove (2*a*), so that the end of the lamp vessel (2) sits with a press fit on the stop (5*a*).

5 Claims, 1 Drawing Sheet

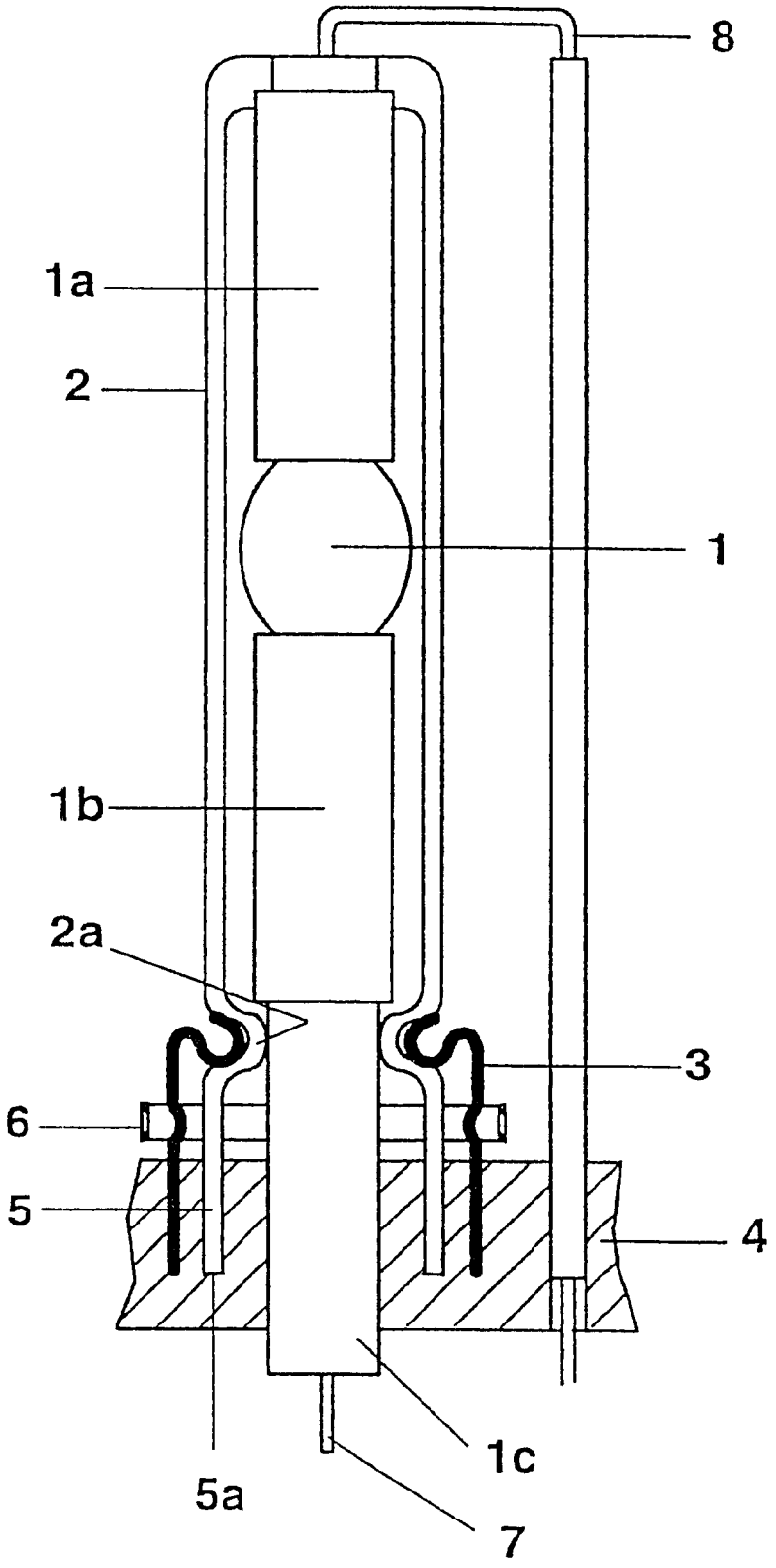
8
1a
2
1
1b
2a
3
6
5
4
1c
5a
7

ELECTRIC LAMP WITH A BASE ON ONE SIDE

The invention relates to an electric lamp with a base on one side according to the preamble of Patent claim 1.

I. Prior Art

An electric lamp of this type is disclosed, for example, by the European Laid-Open Specification EP 0 786 791 A1.

II. Summary of the Invention

It is the object of the invention to provide an electric lamp that has a base on one side with a base which permits simple fixing of the lamp vessel in the base, in particular without the application of high-frequency welding.

According to the invention, this object is achieved by the features of Patent claim 1. Particularly advantageous embodiments of the invention are described in the sub-claims.

The base of the electric lamp with a base on one side according to the invention has a holder for a lamp vessel, the holder is provided with a stop for one end of the lamp vessel, and spring elements for fixing the lamp vessel in the base. According to the invention, the lamp vessel is equipped with an annular groove, and the spring elements are designed such that they act on the lamp vessel in the area of the annular groove, so that the end of the lamp vessel sits with a press fit on the stop. These measures permit purely mechanical fixing of the lamp vessel in the base. Fusing the lamp vessel into the plastic material of the base is not necessary. The spring elements are advantageously designed such that not only is the end of the lamp vessel pressed against the stop in the base but that, in addition, the lamp vessel is also arranged with a clamp fit between the spring elements. The base preferably has at least three spring elements, which are arranged annularly along the groove. In order to reinforce the press fit and/or clamp fit, a sleeve is advantageously provided, which acts on the spring elements. In the case of a discharge lamp equipped with a discharge vessel, the lamp vessel is advantageously designed as an outer bulb which encloses the discharge vessel, the outer bulb being joined to the discharge vessel in the area of the groove. In the area in which they are joined, the two lamp vessels consisting of glass, the discharge vessel and outer bulb, have the greatest stability, so that there is no fear of any breakage of glass as a result of the action of the spring elements on the outer bulb.

DESCRIPTION OF THE PREFERRED EXEMPLARY EMBODIMENT

The invention will be explained in more detail below using a preferred exemplary embodiment. The FIGURE shows a schematic illustration of a cross section through an electric lamp with a base on one side according to the preferred exemplary embodiment of the invention.

The preferred exemplary embodiment of the invention is a high-pressure discharge lamp which has a base on one side and which, for example, can be used as a motor vehicle head lamp. This lamp has a discharge vessel 1 which is sealed on two sides and has the sealed ends 1*a*, 1*b*, and an outer bulb 2. The outer bulb 2 is joined to the end 1*a* remote from the base and to the tube-like extension 1*c* of the discharge vessel 1, which adjoins the end 1*b* close to the base. The outer bulb 2 is a substantially tube-like design and, in the area in which it is joined to the tube-like extension 1*c*, has an annular groove 2*a*. The groove 2*a* defines a depression running like an annulus in the outer circumferential surface of the outer bulb 2. The free ends of four metal springs 3 arranged uniformly along the annular circumference of the groove 2*a* engage in the groove 2*a*. The metal springs 3 are fixed in the inner part 4 of the base, which consists of plastic. The inner part 4 of the base is used to fix the lamp vessel 1, 2 to the base. For this purpose, the inner part 4 of the base has an annular holder 5 for the outer bulb 2. The bottom 5*a* of the holder 5 forms a depth stop for the end of the outer bulb 2 close to the base. The metal springs 3 are shaped in such a way that firstly, they exert pressure against the outer wall of the outer bulb 2 and they secondly, press the outer bulb 2 against the bottom 5*a* of the holder 5. For this purpose, the free ends of the metal springs 3 are bent back in the direction of the inner part 4 of the base and are preferably wedged in the groove 2*a*. According to the preferred exemplary embodiment, the free ends of the metal springs 3 wedged in the groove 2*a* are of hook-like design. In this way, the outer bulb 2 is arranged between the metal springs 3 with a clamp fit and held with a press fit in the holder 5. In order to increase the clamping or pressing action of the metal springs 3, an annular sleeve 6 is provided, which is slipped over the metal springs 3.

The inner part 4 of the base is inserted into the base sleeve (not depicted), which has the electrical connections of the lamp. The current feed 7 close to the base and running in the tube-like extension 1*c* of the discharge vessel 1, and the current return 8 projecting from the end 1*a* of the discharge vessel 1 remote from the base, which are used for the power supply for the gas discharge electrodes (not depicted) arranged in the discharge chamber of the discharge vessel 1, are electrically conductively connected to the electrical connections of the base sleeve. The base sleeve is described, for example, in the Laid-Open Specification EP 0 786 791 A1.

What is claimed is:

1. An electric lamp with a base on one side, having a base (4) which has a holder (5) for a lamp vessel (2), the holder (5) being provided with a stop (5*a*) for one end of the lamp vessel (2), and the base (4) having spring elements (3) for fixing the lamp vessel (2) in the base (4), characterized in that the lamp vessel (2) is equipped with an annular groove (2*a*), and the spring elements (3) are designed such that they act on the lamp vessel (2) in the area of the annular groove (2*a*), so that the end of the lamp vessel (2) sits with a press fit on the stop (5*a*).

2. The electric lamp with a base on one side as claimed in claim 1, characterized in that the lamp vessel (2) is arranged with a clamp fit between the spring elements (3).

3. The electric lamp with a base on one side as claimed in claim 1, characterized in that the lamp is a discharge lamp equipped with a discharge vessel (1), and the lamp vessel (2) is designed as an outer bulb which encloses the discharge vessel (1), the outer bulb (2) being joined to the discharge vessel (1) in the area of the groove (2*a*).

4. The electric lamp with a base on one side as claimed in claim 1, characterized in that the base (4) has at least three spring elements (3), which are arranged annularly along the groove (2*a*).

5. The electric lamp with a base on one side as claimed in claim 1, characterized in that in order to reinforce the press fit and/or the clamp fit, a sleeve (6) is provided, which acts on the spring elements (3).

* * * * *